United States Patent [19]

Kelley et al.

[11] Patent Number: 4,546,849

[45] Date of Patent: Oct. 15, 1985

[54] MACHINE OPERATORS COMPARTMENT

[75] Inventors: Barry R. Kelley, Ashland; Maurice K. LeBegue, Argillite, both of Ky.; Earl C. Michael, Hoyleton, Ill.

[73] Assignee: National Mine Service Company, Pittsburgh, Pa.

[21] Appl. No.: 603,105

[22] Filed: Apr. 23, 1984

[51] Int. Cl.[4] ..... E21D 19/00

[52] U.S. Cl. ..... 180/326; 180/89.13; 180/317

[58] Field of Search ..... 180/89.1, 89.13, 317, 180/326; 296/190

[56] References Cited

U.S. PATENT DOCUMENTS

| | | | |
|---|---|---|---|
| 2,282,749 | 5/1942 | Russell | 180/89.13 |
| 3,053,562 | 9/1962 | Farber | 296/26 |
| 3,675,966 | 7/1972 | Luft | 296/28 C |
| 4,022,026 | 5/1977 | Childress | 61/63 |
| 4,050,256 | 9/1977 | Childress | 61/63 |
| 4,078,629 | 3/1978 | Kutay et al. | 180/89.13 |
| 4,157,878 | 6/1979 | Jamison | 405/303 |
| 4,190,385 | 2/1980 | Childress | 180/89.13 |
| 4,365,682 | 12/1982 | Frey et al. | 180/89.13 |

FOREIGN PATENT DOCUMENTS

| | | |
|---|---|---|
| 1217802 | 5/1966 | Fed. Rep. of Germany . |
| 1260995 | 2/1968 | Fed. Rep. of Germany . |

*Primary Examiner*—William A. Cuchlinski, Jr.
*Attorney, Agent, or Firm*—Stanley J. Price, Jr.

[57] ABSTRACT

An operator's compartment for a mobile machine, such as a machine used in underground mining operations, is pivotally connected to the machine frame for positioning at a preselected elevation above the ground or in contact with the ground to follow the contour of the ground in a "free floating" condition. The first overhead canopy is supported above the operator's compartment at a fixed elevation. Positioned beneath the first overhead canopy is an operator's seat securely positioned on the platform to provide an operator's station from which the machine is operated. Positioned in underlying relation with the first overhead canopy is a second overhead canopy that extends forwardly from the operator's station. The first and second canopies provide for complete overhead protection of an operator. The second overhead canopy is pivotally connected at one end to the machine frame and includes at the opposite end a control panel which is suspended downwardly from the second overhead canopy to a position opposite the operator's seat. Suitable height adjustment means, such as a fixed length or piston cylinder assembly, is connected to the second overhead canopy to permit adjustments in the elevation of the second canopy and the control panel. With this arrangement not only is the second canopy adjustable relative to the first, but the control panel may be repositioned on the platform to allow a change in the position of the controls to suit the operator.

20 Claims, 6 Drawing Figures

MACHINE OPERATORS COMPARTMENT

1. BACKGROUND OF THE INVENTION

This invention relates to an operator's compartment for a mobile machine and, more particularly, to an operator's compartment having an upper canopy and a lower canopy which is movable independently of the upper canopy and supports a control panel which is movable with the lower canopy to a preselected operator position.

2. DESCRIPTION OF THE PRIOR ART

It is well known in underground mining operations to provide overhead protection for machine operators and particularly operators of shuttle cars, mining machines, mine roof drilling, bolting and plating machines, and various other machines which include an operator's station or platform. U.S. Pat. No. 4,022,026 discloses a safety shield attachment which is pivotally connected to a mounting assembly on a mobile machine used in underground mining operations. The attachment includes a canopy which is vertically adjustable above a control station. One end of the canopy is pivotally connected to the machine frame, and a free end of the canopy is connected by hydraulic jacks to a platform of the control station. The platform can be suspended from the canopy at a fixed level above the ground or allowed to rest in a "free floating" condition on the ground. The canopy is maintained in its adjusted position by diagonal bracing. The machine controls are mounted in a fixed position on the platform.

Other examples of devices for providing overhead protection of a machine operator in an underground mine or in any environment in which overhead protection for a machine operator is required is disclosed in U.S. Pat. Nos. 4,050,259; 4,078,629; 4,157,878 and 4,365,682. Each of these devices provide operator compartments that are "free floating". The compartment normally rests and slides over the floor of the mine and is free to move vertically upwardly and downwardly as the elevation of the mine floor changes. To permit independent movement of the operator compartment relative to the mobile machine, U.S. Pat. Nos. 4,078,629 and 4,157,878 disclose the compartment attached to the machine frame by a vertical slide assembly. In U.S. Pat. No. 4,365,682 the operator compartment is both pivotal about a horizontal axis and movable vertically relative to the machine frame.

With each of these devices, the operator compartment includes a platform from which operation of the machine is controlled. A seat is positioned on the platform. Located adjacent to the operator's seat is a control panel or console containing a plurality of individual controls, such as levers, connected electrically or hydraulically to various devices, such as the tram motor, conveyor motor, lights, etc. With the above described operator compartments, the control panel is fixed in a position beneath the overhead canopy so that when the operator is manipulating the controls he is protected overhead. In view of the fact that the control panel and individual controls are in a fixed position, the canopy must overlie a substantial portion of the control station so that the operator is provided with overhead protection while he is operating the machine. This requires a rather expansive overhead canopy which must be sturdily supported on the platform in a manner to permit adjustment in the height of the canopy. However, the weight of the platform and attached canopy must be minimized to permit vertical and pivotal movement of the platform and canopy.

In underground mining operations the machine may operate in a mine where the overhead clearance may vary considerably. Consequently, the canopy must be easily movable through a wide vertical range, and for large canopies this is a problem. While the platform is vertically adjustable, the control panel is in a fixed position. With the known arrangements the control panel is not adjustable relative to the canopy, nor is it adjustable relative to the position of the operator's seat, which in most cases is adjustable.

The operator's seat can be moved closer to or further away from the control panel, but the control panel cannot be moved relative to the canopy. A change in position of the canopy may interfere with the operator's access to the control panel. As a result, given adjustments in the height of the canopy and the position of the operator's seat, the control panel may not be conveniently located for the machine operator.

Therefore, there is need in underground mobile machinery for an operator's compartment having complete overhead protection which is easily adjustable. The control panel in the operator's compartment must be movable to a desired location in the operator's compartment in response to adjustments in the position of the overhead canopy. While it is known to provide an operator's compartment and an overhead canopy which are vertically adjustable, the position of the control panel in the compartment is not adjustable relative to the operator's seat or the overhead canopy.

SUMMARY OF THE INVENTION

In accordance with the present invention, there is provided an operator's compartment for a mobile machine that includes a machine frame. A support structure is positioned adjacent to the machine frame. The support structure includes a base connected to the machine frame. An operator's platform for a machine operator is positioned on the base. A protective canopy overlies the operator's platform and is movably connected to the machine frame for height adjustment relative to the operator's platform. A control panel including means for controlling operation of the mobile machine is connected to the protective canopy and extends downwardly therefrom. Means is provided for supporting the protective canopy in a preselected position relative to the operator's platform for locating the control panel at a desired elevation for a machine operator.

Further in accordance with the present invention there is provided an overhead canopy for protecting the operator of a machine that includes a machine frame. An operator compartment is connected to the machine frame, and an operator's station is positioned in the operator compartment. A first canopy is connected to the operator compartment and is positioned at a selected elevation overlying a portion of the operator's station. A second canopy is pivotally connected to the machine frame and extends into overlying relation with the remaining portion of the operator's station not covered by the first canopy to provide with the first canopy complete overhead protection for the operator's station. The second canopy extends into overlying relation with the first canopy. Operator controls for controlling operation of the machine are suspended from the second canopy. Means is provided for supporting the second canopy in a preselected position for locating the operator controls at a desired elevation in the operator compartment.

The present invention also includes apparatus for providing overhead protection for a machine operator that includes a machine frame. A platform is connected to the machine frame for supporting a machine operator. A protective canopy is positioned in spaced, overlying relation with the platform. The protective canopy has a first end portion connected to the machine frame and a second end portion. An operator control panel is suspended from the protective canopy second end portion. Height adjustment means raises and lowers the protective canopy to position the operator control panel at a preselected elevation on the platform for access to the machine operator.

Accordingly, the principal object of the present invention is to provide for a mobile machine an operator compartment adjustably connected to the mobile machine and including an overhead canopy which is movable with a control panel to a preselected position to provide complete overhead protection for the machine operator while permitting adjustments in the position of the control panel as desired by the machine operator.

Another object of the present invention is to provide an overhead canopy for protecting the operator of a machine in which the machine controls are independently movable relative to the operator's position beneath the overhead canopy.

A further object of the present invention is to provide an operator's compartment adjustably positioned on a machine used in underground mining operations in which the compartment includes a control panel suspended from one portion of a canopy system for independent movement relative to another portion of the canopy system to provide complete overhead protection for the machine operator for any position of the compartment relative to the machine or for any position of the control panel relative to the operator in the compartment.

These and other objects of the present invention will be more completely disclosed and described in the following specification, the accompanying drawings, and the appended claims.

DESCRIPTION OF THE PREFERRED EMBODIMENTS

Figure 1:
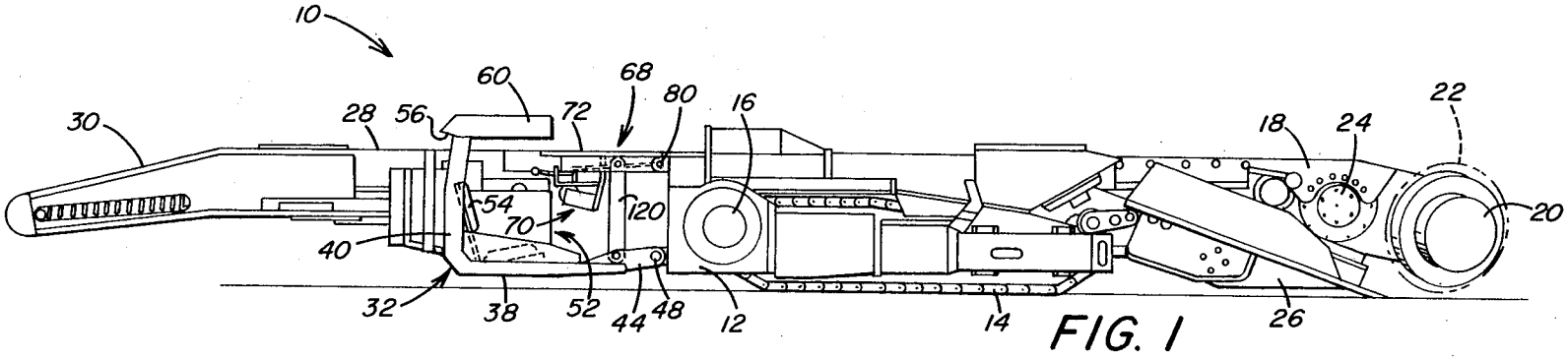
FIG. 1 is a view in side elevation of a self-propelled mining machine, illustrating an operator's compartment having a canopy system adjustably positioned to provide complete overhead protection for the machine operator and the operator controls.
Figure 2:
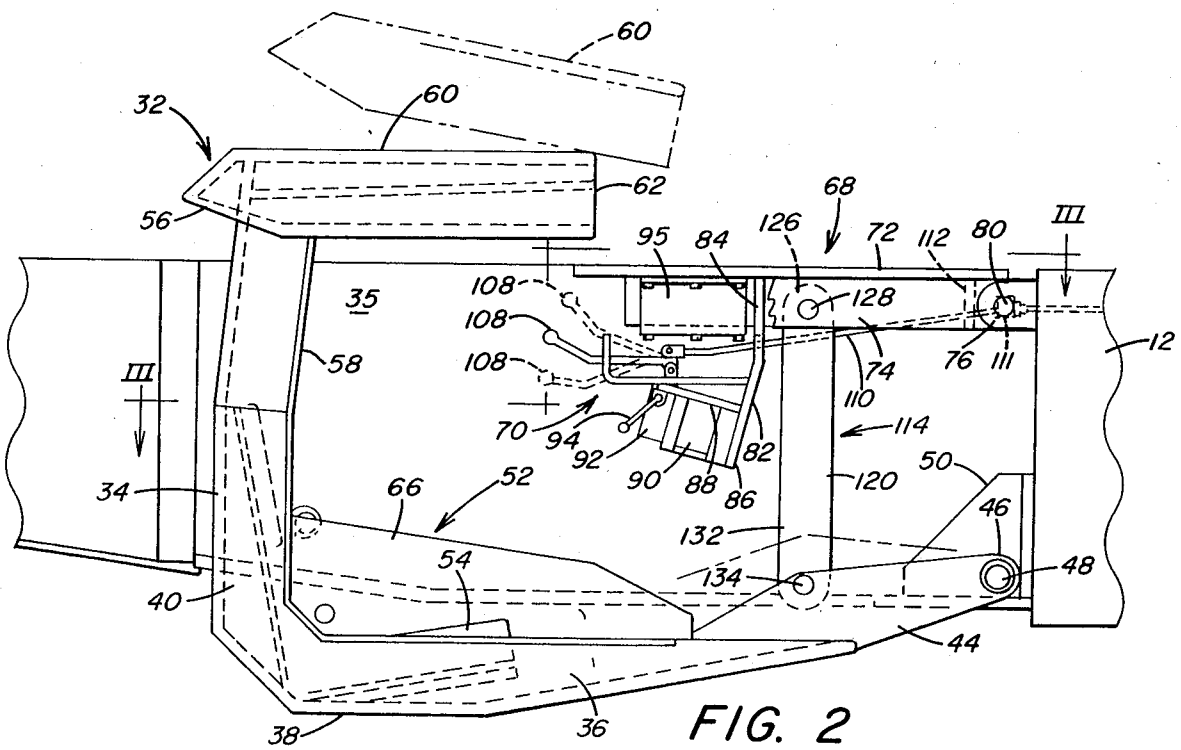
FIG. 2 is an enlarged fragmentary view in side elevation of the operator's compartment on the mining machine shown in FIG. 1, illustrating an upper canopy positioned above an operator's station and a movable lower canopy that supports a control panel.

Referring to the drawings and particularly to FIGS. 1 and 2, there is illustrated a continuous mining machine, generally designated by the numeral 10 having a body or frame portion 12 suitably mounted on endless crawler tracks 14. A propulsion or tram motor 16 is mounted on the frame portion 12 and is drivingly connected to the crawler tracks 14 to turn the crawler tracks and advance the mining machine 12 to carry out the mining operation in an underground mine. A boom member 18 extends forwardly from the frame portion 12 and rotatably supports a material dislodging device, such as a cutter drum 20. The cutter drum 20, as well known in the art, extends transversely across the boom member 18 and includes a plurality of cutting elements that extend peripherally from the cutter drum 20 to form a cutting pattern 22 as schematically illustrated in FIG. 1. The boom member 18 is pivotally mounted on the frame portion 12 to move upwardly and downwardly to dislodge material from a mine face by a shear cut as the cutter drum 20 rotates. The cutter drum 20 is rotated by cutter drum motors 24 mounted on the boom 18.

The material dislodged by the cutter drum 20 is picked up and deposited onto a gathering device 26 that is positioned below the boom member 18. The gathering device 26 feeds the dislodged material onto an endless conveyor means 28 that conveys the material from the front of the mining machine to an articulated rear discharge section 30. The dislodged material is transferred from the conveyor discharge section 30 into a suitable haulage vehicle, such as a shuttle car, or onto a belt conveyor for transportation of the dislodged material out of the mine.

A protected operator's compartment generally designated by the numeral 32 is positioned at the rearward end portion of the mining machine 10 adjacent the conveyor discharge section 30. The operator's compartment 32 is pivotally connected to the machine frame portion 12 for independent movement on the machine portion 12 for positioning, for example, at a preselected elevation above the ground or on the ground for "free floating" movement over the contour of the ground. The movement of the operator's compartment 32 when positioned on the ground or mine floor is independent of the movement of the frame portion 12 to permit the compartment 32 to move upwardly and downwardly as it travels over the contour of the mine floor or obstacles on the mine floor.

As illustrated in greater detail in FIG. 2, the operator's compartment 32 is formed by a support structure 34 that is positioned adjacent to a side wall 35 of the machine frame portion 12. The support structure 34 includes a base 36 that is adapted in one mode of operation of the operator's compartment 32 to contact the mine floor and follow the contour of the mine floor as the mining machine 10 moves during the mining operation. As further illustrated in FIG. 4, the base 36 of the support structure 34 has a generally U-shaped configuration formed by a bottom wall 38 and upwardly extending side walls 40 and 42. The bottom wall 38 extends downwardly from and forwardly from the side walls 40 and 42. A pair of arms 44 extend forwardly from the bottom wall 38.

The arms 44 are rigidly connected, as by welding, to the bottom wall 38. The arms 44 include free end portions 46 that are connected by pivot pins 48 to bracket plates 50 that are connected to and extend from the machine frame portion 12. With this arrangement the bracket plates 50 are spaced a preselected distance apart and extend from the machine frame portion 12 to receive therebetween the base 36 of the operator's compartment 32 to permit the pivot connection of arms 44 to the bracket plates 50. Thus, the operator's compartment 32 is pivotal relative to the machine frame portion 12 about the pivot pins 48.

In one mode of operation the operator's compartment 32 is pivoted downwardly into contact with the mine floor. In another mode of operation the operator's compartment 32 is pivoted upwardly to position the bottom wall 38 in an elevated position above the mine floor. The above described pivotal connection facilitates the "free floating" movement of the compartment 32 when the bottom wall 38 remains in contact with the mine floor during movement of the mining machine 10. Various means (not shown) can be utilized to stabilize the position of the operator's compartment 32 either in a "free floating" or an elevated position. This can be accomplished by connecting the operator's compartment 32 to the machine side wall 35 by the guide rail arrangements disclosed in U.S. Pat. Nos. 4,078,629 and 4,157,878, or by other suspension systems known in the art. The details of these arrangements are beyond the scope of the present invention.

Figure 4:
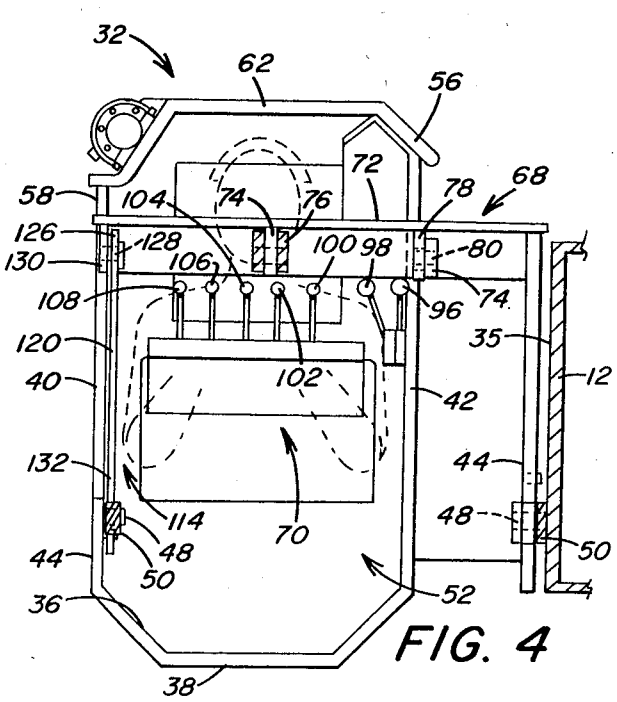
FIG. 4 is an end view of the operator's compartment taken along line IV—IV of FIG. 3.
Figure 3:
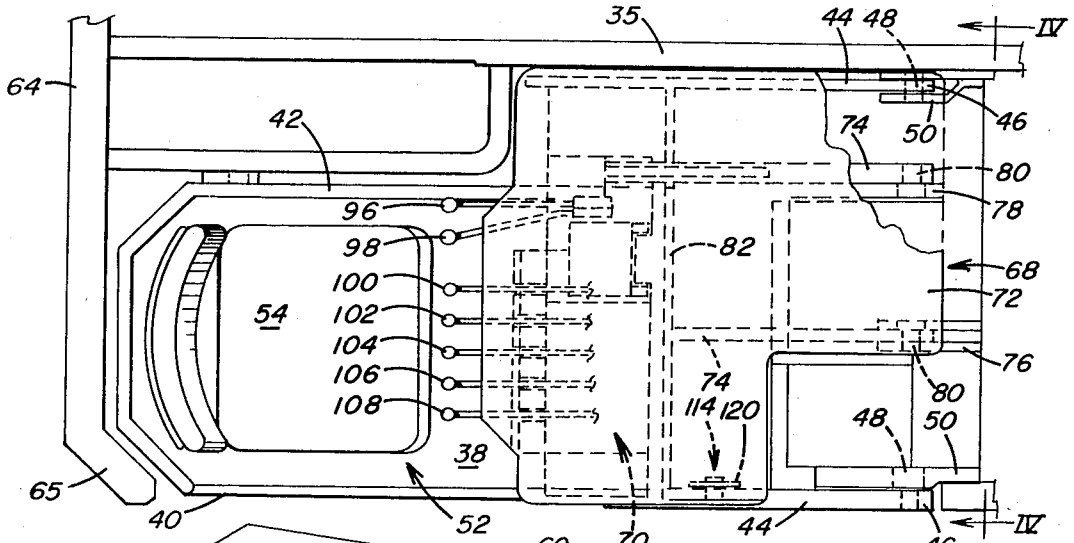
FIG. 3 is a top plan view of the operator's compartment taken along line III—III of FIG. 2.

As illustrated in FIGS. 2, 3, and 4, the compartment bottom wall 38 together with the upwardly extending side walls 40 and 42 define a platform 52. A seat 54 is positioned on the platform 52 to form an operator's station where the mining machine operator sits, as diagramatically illustrated in FIG. 4, for operating the mining machine 10 during the mining operation. The seat 54 is securely connected to the base 36 and is adjustable forwardly and backwardly. Extending upwardly from the side walls 40 and 42 and overlying the seat 54 is an upper canopy 36. The upper canopy 56 includes a post portion 58 suitably connected, as by welding, to the side walls 40 and 42 and a shield portion 60. The shield portion 60 is rigidly connected at one end to the upper end of the post portion 58 and extends outwardly therefrom to a free end portion 62. The shield free end portion 62 extends over the seat 54 to provide overhead protection for the operator when positioned in the seat 54. While the shield portion 60 provides overhead protection, lateral protection for the operator is provided by the machine side wall 35 and a protector plate 66 that extends upwardly from the base 36 and outwardly from the side wall 40.

The operator's compartment 32 includes suitable means for stabilizing or guiding the operator's compartment 32 for upward and downward movement as it pivots about the pivot pins 48, as discussed above. This can be accomplished in a number of ways, for example by the provision of a stabilizer cylinder (not shown) pivotally connected at one end to the base 36 and including an extensible piston pivotally connected to the mining machine side wall 35 adjacent to the operator's compartment 32. By extension and contraction of the stabilizing cylinder, the operator's compartment 32 and upper canopy 56 can be pivoted to a preselected elevated position or pivoted for "free floating" movement on the mine floor.

Another arrangement for stabilizing the compartment 32 in the "free floating" position relative to the machine frame portion 12 is shown in FIG. 3 and includes the provision of a wrap-around bumper 64. The bumper 64 is connected to the frame sidewall 35 and extends outwardly therefrom. An end portion 65 of bumper 64 extends around the sidewall 40 of the compartment 32 and conforms to the angle of the sidewall 40. The bumper 64 prevents the compartment 32 from swinging away from the sidewall 35 as the compartment 32 moves freely upwardly and downwardly in traveling on the uneven surface of the mine floor. Thus the bumper 64 confines the compartment 32 to upward and downward movement.

In the elevated position the compartment 32 is at a fixed level. In the "free floating" position the compartment 32 is vertically movable to ride on the uneven surface of the mine floor. The phantom lines in FIG. 2 illustrate the elevated position of the compartment 32 and the upper canopy 56. By raising and lowering the compartment 32, the height of the upper canopy 56 is adjustable to insure clearance between the top of the shield portion 60 and the mine roof to prevent the shield portion 60 from striking the mine roof and impeding the operation of the mining machine.

Further in accordance with the present invention there includes a second or lower canopy generally designated by the numeral 68. The lower canopy 68 extends from the mining machine frame portion 12 into spaced, underlying relationship with the free end portion 62 of the shield portion 60 of the upper canopy 56. The lower canopy 68 is positioned above the portion of the platform 52 not covered by the upper canopy 56. Thus, the overlying combination of the upper canopy 56 and the lower canopy 68 provides complete overhead protection for the machine operator when positioned in the seat 54. While the upper canopy 56 provides overhead protection for the upper body and head of the machine operator, the lower canopy 68 provides overhead protection for the lower body and legs of the operator.

The lower canopy 68 is independently supported relative to the upper canopy 56. The lower canopy 68 is also pivotally movable relative to the upper canopy 56. This facilitates suspension of a control panel generally designated by the numeral 70 from the lower canopy 68. Movement of the lower canopy 56 permits adjustments in the position in the control panel 70 within the operator's compartment 32. The control panel 70 can be moved to the desired position to suit the size of the machine operator.

The lower canopy 68 is formed by a frame structure that includes, as illustrated in FIGS. 2–4, a shield portion 72 formed by a plate, illustrated in FIG. 3, having a width substantially corresponding to the distance between the operator's compartment outer side wall 40 and the mining machine side wall 35. The length of the shield portion 72 has a minimum dimension extending from its connection to the mining machine frame portion 12 at one end to an opposite end that underlies the free end portion 62 of the upper shield portion 60. With this arrangement, the shield portion 72 provides additional overhead protection for the portion of the machine operator not exclusively covered by the upper shield portion 60.

The plate forming the shield portion 72 is welded to a pair of spaced apart longitudinally extending beams 74. To pivotally support the lower canopy 68 on the mining machine frame portion 12, a pair of brackets 76 and 78 extend from outwardly from the mining machine frame portion 12. The beams 74 are connected to the brackets 76 and 78 by pivot pins 80. This arrangement permits upward and downward pivotal movement of the lower canopy 68 on the mining machine frame portion 12 about the pivot pins 80.

As illustrated in FIG. 2, the lower canopy 68 underlies the upper canopy 56. Preferably the lower shield portion 72 is spaced below the front end portion 62 of the upper shield portion 60 to provide minimum clearance therebetween. The distance between the overlying canopies 56 and 68 varies as determined by the pivoted position of the lower canopy 68 within the operator's compartment 32.

The control panel 70, as illustrated in FIG. 2, extends downwardly from the lower shield portion 72 and is formed by a bracket 82 having an upper end portion 84 suitably connected, as by welding, to the shield portion 72. The bracket 82 has a lower or free end portion 86. Preferably the bracket 82 extends substantially the width of the shield portion 72 for locating the control panel 70 across the width of the operator's compartment 32. A control housing 88 is rigidly connected to the bracket free end portion 86. The housing 80 also extends substantially the width of the shield portion 72 and the bracket 82.

The control housing 88 supports a plurality of devices to be manipulated and monitored by the machine operator. For example, a methane monitor case 90 is shown in FIG. 2 secured to the control housing 88 in a position to be clearly visible to the machine operator for monitoring the methane content in the air surrounding the mining machine. Also positioned on the control housing 88 is a tram case 92 provided with a control lever 94 by which all of the tram functions of the mining machine 10 are controlled. The tram case 92 houses an electrical controller which is actuated by movement of the lever 94 for control of the tram motors 16. Bolted beneath the shield portion 72 is a console 95 housing various meters, such as an ammeter and a voltmeter, and warning lights.

The control panel 70, also supports a plurality of individual control levers 96–108, as illustrated in FIGS. 3 and 4. The individual levers 96–108 control the many functions which are performed by the mining machine 10 in the mining operation, for example upward and downward movement of the boom member 18, operation of the cutter drum motors 24, control of the gathering device 26, operation of the continuous conveyor 28, movement of the articulated conveyor discharge section 30 and other functions. The lever arms 96–108 are mechanically connected to hydraulic valves (not shown) which are operable to actuate the hydraulic circuits that control the various functions performed by the mining machine. Each of the levers 96 and 108 is connected in a well known manner to the respective hydraulic valves.

For the purposes of clarity of illustration, only the control lever 108 is shown in detail in FIG. 2. The control lever 108 includes an end portion which is manipulated by the machine operator to various positions as illustrated in phantom. The lever 108 is connected to a control arm 110 that passes through a guide hole in a plate 112 that extends transversely beneath the shield portion 72. The plate 112 includes corresponding guide holes for each control lever. The control arm 110 has a pivot joint 111 substantially aligned with the pivot pin connection of the lower canopy 68 to the machine frame 12. The outer end of the control arm 110 is conventionally connected to a hydraulic valve which controls the hydraulic circuit for operation of one of the hydraulically controlled devices on the mining machine 10. With this arrangement, when the lower canopy 68 is pivoted, the control rod 10 can also pivot through a limited range without affecting the operating position of the control lever 108. Thus the control panel 70 can be moved to a preselected position as desired by the machine operator and the position of the control levers 96–108 can be maintained.

In accordance with the present invention the lower canopy 68 is independently movable relative to the upper canopy 56. Through the range of pivotal movement of the lower canopy 68 about the pivot pins 80, the lower canopy 68 remains in underlying relation with the upper canopy 56. Thus complete overhead protection of the operator is maintained regardless of the position of the lower canopy 68. The position of the lower canopy 68 determines the location of the control levers 96–108. The control levers 96–108 are positioned at a desired elevation in the operator's compartment 32 to suit the operator's size and also to facilitate repositioning of the control levers in response to the position of the operator's compartment 32.

Figure 6:
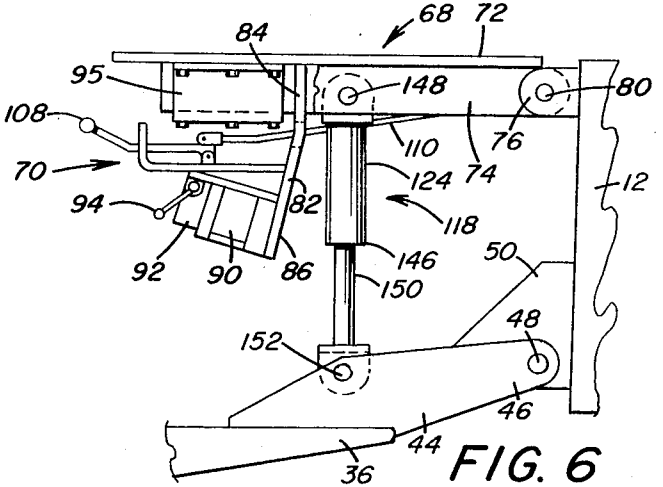
FIG. 6 is an enlarged fragmentary schematic illustration of another embodiment for adjustably positioning the lower canopy and the control panel.
Figure 5:
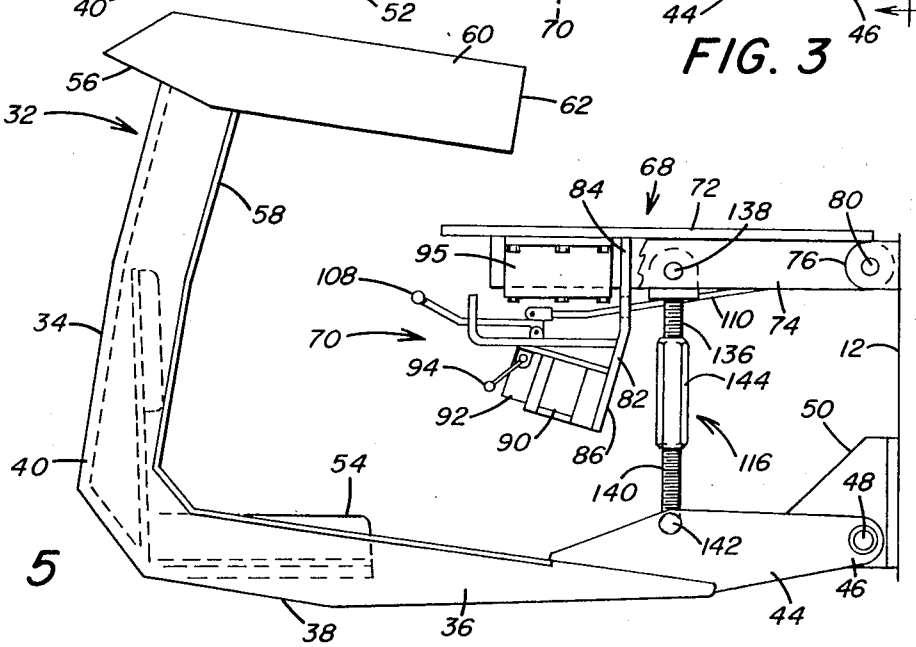
FIG. 5 is an enlarged fragmentary schematic illustration of one embodiment for adjustably positioning the lower canopy and the control panel in the operator's compartment.

When the lower canopy 68 is in the desired position for locating the control panel 70, the position of the lower canpy 68 is maintained by suitable height adjustment apparatus generally designated by the numeral 114 in FIG. 2. Alternative height adjustment apparatus 116 and 118 are shown in FIGS. 5 and 6. The height adjustment apparatus 114 includes a bar linkage 120. The apparatus 116 in FIG. 6 includes an adjustable link 122, and the corresponding apparatus 118 in FIG. 6 includes a hydraulic cylinder 124.

The bar linkage 120 illustrated in FIGS. 2 and 4 has a fixed length with an upper end portion 126 connected by a pin 128 to a portion 130 depending from the shield portion 72. A lower end portion 132 of the bar linkage 120 is connected by a pin 134 to the arm 44 of the operator's compartment base 136. The bar linkage 120 rigidly supports the lower canopy 68 at a preselected elevation in the operator's compartment 32 corresponding to the desired position of the control panel 70 for the machine operator. If it is desired, for example, to lower the position of the control levers from the position illustrated in FIG. 2, then the bar linkage 120 shown in FIG. 2 is substituted for a bar linkage of a shorter length so that the control panel 70 can be maintained in a lower position. Accordingly, the length of bar linkage 120 not only determines the position of the control panel 70 in the operator's compartment, but also the elevation of the lower canopy 68 above the operator's compartment. While a bar linkage of a fixed length is shown in FIG. 2, it should be understood that the bar linkage can include suitable means, such as adjustment holes or a longitudinal slot, for adjusting the elevation of the lower canopy 68 without changing a bar linkage of one length for a bar linkage of another length.

The height adjustment apparatus 116 in FIG. 5 includes a turnbuckle for connecting in an adjustable manner the lower canopy 68 to the arm 44 on the operator's compartment base 36. The turnbuckle is conventional in design and includes an upper threaded rod 136 pivotally connected by a pin 138 to the canopy depending portion 130 and a lower threaded rod 140 pivotally connected by a pin 142 to the arm 44. An internally threaded link 144 receives the respective ends of the threaded rods 136 and 140. Rotation of the link 144 in a preselected direction moves, for example, the upper threaded rod 136 into or out of the link 144 to pivot downwardly or upwardly the lower canopy 68 to, in turn, adjust the position of the control panel 70 in the operator's compartment 32.

Automatic adjustment of the pivoted position of the lower canopy 68 is also accomplished by the embodiment of the adjustment apparatus 118 shown in FIG. 6 which includes a hydraulic cylinder assembly 124. The hydraulic cylinder assembly 124 includes a cylinder portion 146 pivotally connected by a pin 148 to the canopy depending portion 130. A piston rod 50 is extensible and retractable relative to the cylinder portion 146 and is pivotally connected at its outer end portion by a pin 152 to the arm 44. Extension of the piston rod 150 out of the cylinder portion 146 pivots the lower canopy 68 upwardly about the pivot pins 80. Retraction of the piston rod 150 into the cylinder portion 146 pivots the lower canopy 68 downwardly. Accordingly, the relative extension or retraction of the piston rod 150 moves the lower canopy 68 and the control panel 70 to the desired position in the operator's compartment 32.

Not only does the provision of suspending the control panel 70 from the pivotal canopy 68 permit adjustments in the position of the control panel 70 in the operator's compartment 32, it also permits the control panel 70 to be moved to a position for unimpeded access to the area of the operator's compartment 32 immediately beneath the control panel 70 for performing maintenance when the mining machine is not in operation. Thus with the present invention the canopies 56 and 68 are independently supported and the lower canopy 68 is adjustable relative to the upper canopy 56. This provides flexibilty in adjusting the position of the entire canopy system to meet a wide range of overhead clearance requirements. The feature of suspending the control panel 70 from the movable canopy portion 68 also assures that the machine operator is protected overhead while operating the controls.

According to the provisions of the patent statutes, we have explained the principle, preferred construction and mode of operation of our invention and have illustrated and described what we now consider to represent its best embodiments. However, it should be understood, that within the scope of the appended claims, the invention may be practiced otherwise than as specifically illustrated and described.

We claim:

1. An operator's compartment for a mobile machine comprising, a machine frame, a support structure positioned adjacent to said machine frame, said support structure including a base connected to said machine frame, an operator's platform for a machine operator positioned on said base, a protective canopy overlying said operator's platform and movably connected to said machine frame for height adjustment relative to said operator's platform, a control panel including means for controlling operation of the mobile machine, said control panel being connected to said protective canopy and extending downwardly therefrom, and means for supporting said protective canopy in a preselected position relative to said operator's platform for locating said control panel at a desired elevation for a machine operator.

2. An operator's compartment as set forth in claim 1 in which, said base is pivotally connected to said machine frame to move relative to said machine frame, said means for supporting said protective canopy including a linkage connecting said protective canopy to said base, and said protective canopy with said control panel being movable with said base.

3. An operator's compartment as set forth in claim 1 which includes, a plurality of machine control devices mounted on said control panel, said machine control devices being operator controllable for performing selected machine functions, and said control devices being movable with said protective canopy to selectively position said control devices at a desired position above said operator's platform.

4. An operator's compartment as set forth in claim 1 in which, said protective canopy includes a plate member having one end portion connected to said machine frame for pivotal movement about a horizontal axis, said plate member having an opposite free end portion, said control panel connected to suspend downwardly from said plate member free end portion, and said plate member being upwardly and downwardly pivotal about said horizontal axis to adjust the position of said control panel above said operator's platform.

5. An operator's compartment as set forth in claim 1 in which, said base includes one end portion connected to said machine frame for pivotal movement about a horizontal axis, said protective canopy having one end portion connected to said machine frame for pivotal movement about a horizontal axis above the point of connection of said base to said machine frame, and said means for supporting said protective canopy including a member of a preselected length connected at one end to said protective canopy and at the opposite end to said base to support said protective canopy at a preselected pivoted position above said base.

6. An operator's compartment as set forth in claim 1 in which, said base includes one end portion connected to said machine frame for pivotal movement about a horizontal axis and an opposite free end portion, a protective shield supported from said base free end portion at a preselected elevation above said operator's platform, and said protective shield having a free end portion overlying a portion of said protective canopy so that said operator's platform is provided with overhead protection by the combination of said protective shield and said protective canopy.

7. An operator's compartment as set forth in claim 6 which includes, means for moving said protective canopy relative to said protective shield to independently adjust the position of said protective canopy above said base and the position of said control panel above said operator's platform.

8. An operator's compartment as set forth in claim 1 in which, said protective canopy includes one end portion pivotally connected to said machine frame for movement about a horizontal axis and an opposite free end portion, said control panel being suspended from said free end portion at a preselected elevation above said base, and said means for supporting said protective canopy being adjustable to raise and lower said control panel to adjust the position of said control panel above said base.

9. An operator's compartment as set forth in claim 1 which includes, means for adjusting said means for supporting said protective canopy to position said control panel at a desired height above said operator's platform.

10. An overhead canopy for protecting an operator of a machine comprising, a machine frame, an operator compartment connected to said machine frame, an operator's station positioned in said operator compartment, a first canopy connected to said operator compartment and positioned at a selected elevation overlying a portion of said operator's station, a second canopy pivotally connected to said machine frame and extending into overlying relation with the remaining portion of said operator's station not covered by said first canopy to provide with said first canopy complete overhead protection for said operator's station, said second canopy extending into underlying relation with said first canopy, operator controls for controlling operation of the machine suspended from said second canopy, and means for supporting said second canopy in a preselected position for locating said operator controls at a desired elevation in said operator compartment.

11. An overhead canopy as set forth in claim 10 in which, said operator compartment is pivotally connected to said machine frame for movement of both said first and second canopies relative to said machine frame, and said second canopy being independently adjustable to change the position of said canopy with respect to said first canopy.

12. An overhead canopy as set forth in claim 11 in which, said means for supporting said second canopy includes adjustment means for repositioning said second canopy with respect to said first canopy to allow a change of position of said operator controls, and said second canopy being movable to a selected elevation above said operator's station while remaining in underlying relation with said first canopy.

13. An overhead canopy as set forth in claim 10 in which, said operator compartment includes one end portion connected to said machine frame for pivotal movement about a horizontal axis and an opposite end portion for supporting said first canopy at a preselected elevation above said operator's station, said second canopy having one end portion connected to said machine frame for pivotal movement about a horizontal axis spaced above the point of connection of said operator compartment to said machine frame, and said second canopy being pivotal with respect to said first canopy.

14. An overhead canopy as set forth in claim 10 in which, said second canopy has an opposite end portion underlying said first canopy, said operator controls being supported from second canopy second end portion to extend downwardly to a preselected elevation in said operator's station, and second canopy being pivotal about said horizontal axis to raise and lower said operator controls to a desired position in said operator's station.

15. An overhead canopy as set forth in claim 10 in which, said second canopy is connected at one end portion to said machine frame for pivoted movement above said operator's station, said means for supporting said second canopy includes an adjustable link having one end portion connected to said second canopy and an opposite end portion connected to said operator compartment, and said adjustable link having a variable length to raise and lower said second canopy by pivotal movement of said second canopy about said horizontal axis and change the elevation of said operator controls in said operator's station and change the elevation of said second canopy on said operator compartment.

16. Apparatus for providing overhead protection for a machine operator, a machine frame, a platform connected to said machine frame for supporting a machine operator, a protective canopy positioned in spaced, overlying relation above said platform, said protective canopy having a first end portion connected to said machine frame and a second end portion, an operator control panel suspended from said protective canopy second end portion, and height adjustment means for raising and lowering said protective canopy to position said operator control panel at a preselected elevation on the platform for access to the machine operator.

17. Apparatus as set forth in claim 16 in which, said protective canopy first end portion is hinged to said machine frame for pivotal movement about a horizontal axis above said platform, and said height adjustment means being vertically extensible and retractable to pivot said protective canopy about said horizontal axis to adjust the position of said operator control panel above said platform.

18. Apparatus as set forth in claim 16 is which, said platform is pivotally connected to said machine frame for independent movement relative to said machine frame, and said height adjustment means being mounted on said platform and connected to said protective canopy and operable upon actuation to move said protective canopy independent of the movement and position of said platform on said machine frame.

19. Apparatus as set forth in claim 16 which includes, a protective shield supported by said platform at a preselected elevation thereon and above said protective canopy, and said protective shield being positioned in spaced overlying relation with said protective canopy to combine with said protective canopy to provide complete overhead protection above said platform.

20. Apparatus as set forth in claim 19 in which, said height adjustment means is connected at one end to said protective canopy and is supported at an opposite end on said platform for height adjustment of said protective canopy above said platform, and said protective canopy being movable through a vertical range in underlying relation with said protective shield to adjust the position of said operator control panel beneath said protective shield.

* * * * *